United States Patent [19]

Ryckman, Jr.

[11] 4,069,949

[45] Jan. 24, 1978

[54] APPARATUS FOR HEATING AND DISPENSING FLOWABLE MATERIAL

[75] Inventor: William D. Ryckman, Jr., Asheboro, N.C.

[73] Assignee: General Electric Company, Bridgeport, Conn.

[21] Appl. No.: 641,674

[22] Filed: Dec. 17, 1975

[51] Int. Cl.[2] ..... B67D 5/62

[52] U.S. Cl. ..... 222/146 HA; 222/180; 222/509

[58] Field of Search ..... 222/183, 180, 146 HA, 222/402.13, 70, 509; 219/214

[56] References Cited

U.S. PATENT DOCUMENTS

| | | | |
|---|---|---|---|
| 3,100,066 | 8/1963 | Campbell | 222/180 |
| 3,123,260 | 3/1964 | Miles | 222/402.13 |
| 3,269,602 | 8/1966 | Weber | 222/70 |
| 3,666,144 | 5/1972 | Winder | 222/70 |
| 3,749,880 | 7/1973 | Meeks | 219/214 |
| 4,000,834 | 1/1977 | Whitley | 222/180 |

FOREIGN PATENT DOCUMENTS

| | | | |
|---|---|---|---|
| 980,433 | 1/1965 | United Kingdom | 222/402.13 |

*Primary Examiner*—Drayton E. Hoffman
*Assistant Examiner*—John P. Shannon
*Attorney, Agent, or Firm*—John F. Cullen; George R. Powers; Leonard J. Platt

[57] ABSTRACT

In an apparatus for electrically heating and dispensing flowable material from a pressurized container, including a housing supporting the container, a heat exchanger connected to receive material dispensed through a valve assembly, and structure for effecting temperature control of said material, an improvement is provided in the support and valve assembly that comprises a single universal valve assembly member supported on, fixedly secured to, and passing through, the housing to prevent relative motion therebetween, and structure is provided on the valve member extending within the housing to lockingly engage and support a container by a rolled flange on the container. A tubular passage is provided in the valve assembly member and it sealingly and fixedly receives the container outlet telescopically through one end of the passage and it also receives an actuator stem sealingly and spacedly disposed in the other end of the passage for telescopic movement through the passage against the container outlet to release and dispense material. A side passage is provided in the member between the stem and outlet and is connected to the heat exchanger so that the fixed valve member functions as the container support and a universal valve assembly for selectively dispensing controlled, heated, and measured material.

6 Claims, 4 Drawing Figures

Fig. 1.
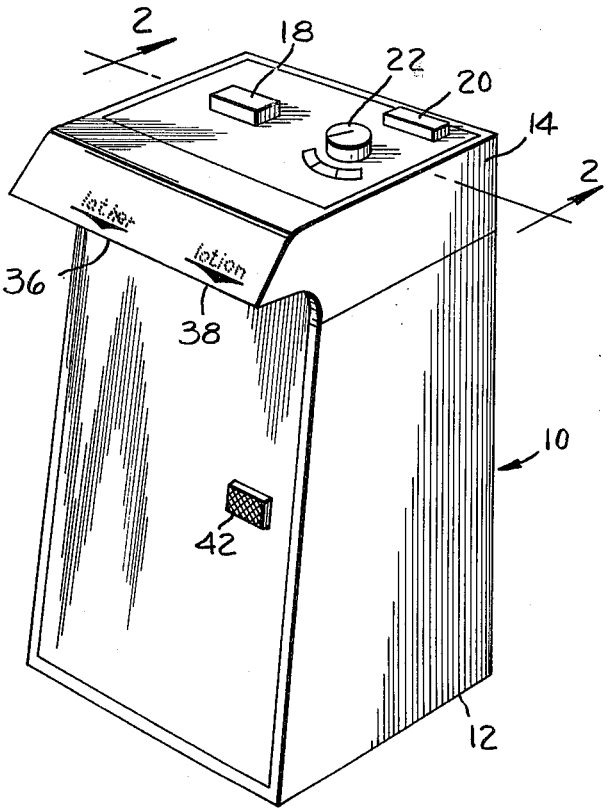
Fig. 3.
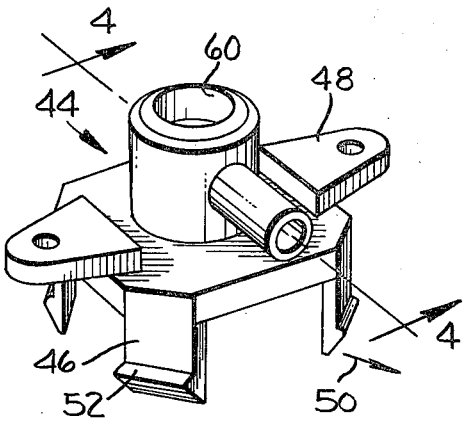
Fig. 2.
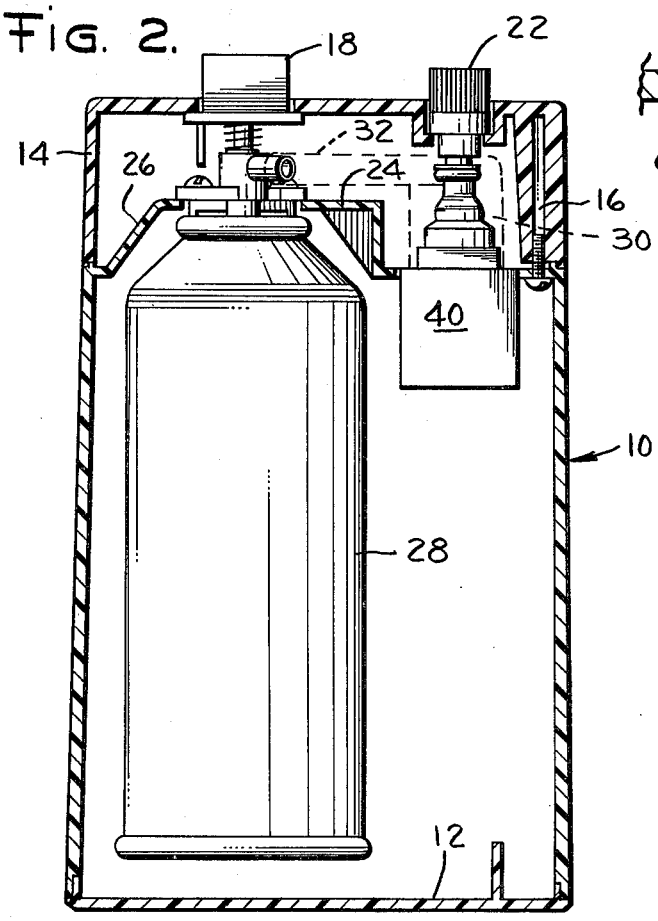
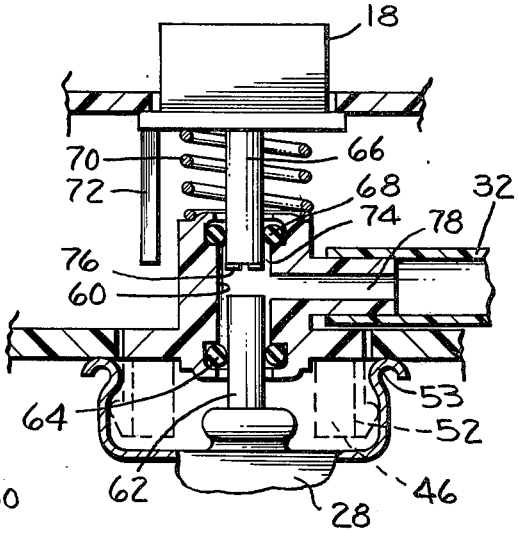
Fig. 4.

APPARATUS FOR HEATING AND DISPENSING FLOWABLE MATERIAL

BACKGROUND OF THE INVENTION

1. Field of the Invention

This invention relates to apparatus for heating flowable material dispensed from pressurized containers and, more particularly, to an improved single integral universal valve assembly that can support many type containers, and control and dispense measured material such as shave cream therefrom.

2. Description of the Prior Art

Apparatus for heating shave cream dispensed from pressurized aerosol containers is known and the containers use a propellant gas to discharge their foam products. The gas is dispersed under pressure and in liquified form in the container and, upon opening of the container discharge valve forces the product out of the container and simultaneously expands, forming gas bubbles and generating foam as is well known in aerosol shaving cream cans.

Expansion has a cooling effect on the foam — undesirable in shaving creams because it is uncomfortable and slow in softening the beard which is more easily shaved when softened by moisture and the softening is generally proportional to the cream temperature. Various heating devices are available for heating foam shave cream as it is dispensed to increase the ease and effectiveness of shaving.

Since the gas bubbles in the foam act as heat insulators the cream is difficult to heat. Also, it has a high viscosity and, if unduly constricted so that it absorbs heat quicker, it may not flow at a useful rate.

Some prior art devices provide a reservoir for hot tap water to heat the shave cream, and others use electric heating means, a typical one being shown in U.S. Pat. No. 3,749,880 of common assignment. Such a device handles many shaving creams as opposed to some devices that handle only one or a few selected container cans. It has a valve assembly tube connected to a heat exchanger. The valve assembly moves up and down flexing the connecting tube and causing wear. The present invention is an improvement on the dispenser of the patent by improving on the support and valve assembly construction.

SUMMARY OF THE INVENTION

Briefly described, the present invention is directed to a combination that avoids the flexing and thus the wear of the connecting tube and provides a valve assembly means that is adapted to universally accept many aerosol containers with differing outlet tubes on the containers. Thus, the invention is directed to an apparatus for electrically heating and dispensing flowable material from a pressurized container including a housing supporting the container, heat exchange means connected to receive material dispensed through a valve assembly and thermostat means effecting temperature control of said material. To this known combination, the invention provides an improvement in the support and valve assembly that comprises a single universal valve assembly member passing through and supported and fixedly secured to the housing to prevent relative motion therebetween. Means, such as spaced integral projections, may depend from the valve assembly and extend into the housing to lockingly engage and support a container through the conventional rolled flange on the container.

A tubular passage is provided in the valve member to sealingly and fixedly receive the container outlet telescopically therein through one end of the passage and an actuator stem is sealingly and spacedly disposed in the other end of the passage for telescopic movement through the passage against the container outlet to release and dispense material, the telescopic fitting in the passage accommodating many differing lengths of container outlets. A side passage is provided in the member substantially between the stem and outlet and is connected to the heat exchanger so that the single fixed universal valve assembly member functions as the sole container support and valve assembly accommodating many containers for selectively dispensing controlled, heated, and measured material. Thus, the main object of the invention is to provide an improved single and integral universal valve assembly fixed in the housing for no movement, that acts as the sole support of the container, that handles any size container, and operates for selectively dispensing controlled, heated, and measured material.

BRIEF DESCRIPTION OF THE DRAWINGS

FIG. 1 is a perspective view of the heated shave cream dispenser;

FIG. 2 is a partial cross-sectional view on line 2—2 of FIG. 1 and showing the heat exchanger location dotted;

FIG. 3 is a perspective view of the single universal valve member;

FIG. 4 is a partial cross-sectional view on line 4—4 of FIG. 3 including the actuator and container with depending dotted projections rotated to show engagement with the container flange.

DESCRIPTION OF THE PREFERRED EMBODIMENT

The invention is described in connection with dispensers of shaving cream although it is applicable to any flowable material and reference is made to co-pending application Ser. No. 641,675 now U.S. Pat. No. 4,000,834 filed concurrently of common assignment showing a preferred detailed supporting valve assembly for the general combination herein.

Referring to FIGS. 1 and 2, there is shown a heated shave cream dispenser having a plastic molded housing 10 and a base 12 readily detachable from the housing for replacement of a pressurized container. A cover 14 is semipermanently attached to the housing from below by screw fasteners 16 to enclose the working parts and provide a base for various indicia and controls such as lather dispenser button 18, lotion button 20, and thermostat 22, which effects temperature control of the lather. Cover 14 is preferably designed to overhang the front portion of housing 10 so the user's hand fits in the overhang to receive heated lather or shaving lotion as indicated in FIG. 1. To support the pressurized container and operating components of the apparatus, the housing has an upper wall 24 that may be molded as part of the housing and formed with a cone-like depression 26 to assist in locating and centering any of a large number of leading brands of foam lather dispenser containers 28.

The rest of the internal operating structure is generally supported on upper wall 24 and consists of a heat exchanger assembly 30 of a tube wrapped around a central heated post and selectively receiving material dispensed from the container through fixed connecting tube 32, the assembly heating and directing the material out through a tube not shown and a dispenser nozzle at 36 under "lather" as indicated on the overhang of cover 14 in FIG. 1 and more fully shown and described in said co-pending application. Similarly, a suitable lotion, not shown, may be stored in the housing and pumped by suitable button 20 to be discharged through a connecting tube at 38 under "lotion" in the overhang of the cover 14 as indicated. The apparatus is designed to automatically heat shaving cream including gels to variable desired temperatures as set by single thermostat button 22, which, upon depression, activates a circuit through thermostat 40 much like an off/on volume control in a TV set. Included in the circuit is suitable indicator light 42 that lights when the circuit is "on" and goes out when the set temperature is reached.

The various heating, thermostat control, and lotion dispensing structure form no part of the present invention except as they fit in the overall package of FIG. 1 with the heat exchanger 30 remotely located from container 28 — a desirable feature as will be apparent.

In accordance with the present invention, an improvement is provided in the support and valve assembly means to support container 28 and operate the dispensing mechanism which improvement avoids any flexing movement whatever of the valve structure and connecting tube 32. Eliminating the tube motion avoids wear on connecting tube 32 from the constant flexing as lather is dispensed. Thus, the mechanism must be firmly fixed in the housing and the only motion be that of depressing the container outlet in the normal manner of the aerosol container. Also, the invention is directed to a valve assembly that accommodates substantially all aerosol-type containers regardless of differing length outlets.

To this end, there is provided a preferably flexible or resilient molded plstic single integral universal-type valve assembly member generally indicated as 44 in FIG. 3. This single molded member is designed to act as the sole support of the container, and with actuator button 18, it also acts as a valve assembly which avoids any flexing and because of its internal structure it also handles containers with different outlet lengths. Thus, it is "universal" in that it accommodates many different aerosol-type containers. Thus, a single member performs several functions with no movement eliminating leaks caused by failure of flexing parts.

Referring to FIG. 3, member 44 is formed with any suitable means for grasping a container such as angularly spaced integral depending projections 46 that may form part of the valve member. To avoid flexing, assembly member 44 is supported on, passes through, and is fixedly secured to the housing upper wall 24 to prevent any relative motion between the housing and valve. Thus, the valve member is solidly fixed to the housing. Preferably, the entire member 44 is a single piece of plastic such as Acrylonitrile Butadiene Styrene better known as ABS or its equivalent which is easily formed by molding into the desired shape. As shown in FIG. 3, depending projections 46 may be any number, four being shown, and it is desirable that projections 46 be biased away from the vertical centerline of member 44 in the direction of arrow 50 as shown in FIG. 3. Additionally, each of the projections has an outwardly extending barb 52 which lockingly engages and supports the container through the conventional rolled flange 53 thereon. The entire valve assembly member 44 is secured to the container upper wall by suitable means such as ears 48 in which screws or other fasteners are affixed to wall 24. This forms substantially the sole container support to the housing as seen in FIG. 4. While containers are generally standardized, the flexibility of the projections 46 allows for some variation in the diameter of rolled flange 53 and thus accommodates many brands of pressurized containers. Thus, member 44 is securely and fixedly locked into upper wall 24 with no relative movement possible and the member forms the sole support for numerous containers 28 as seen in FIG. 2. Additionally, this same structure forms the main part of the dispensing valve assembly as now explained.

In order to selectively pass the measured dispensed material from any size container 28 for heating, and to accomodate numerous different lengths of outlets on the containers, the universal member 44 is fixedly secured to and passes through the housing and is formed with a vertical tubular passage 60 extending completely therethrough. As best shown in FIG. 4, this passage fixedly receives telescopically, container outlets 62, of differing lengths as shown dotted. The outlet extends through one end of the passage and is sealed thereto by a suitable O-ring 64. In the same manner, an actuator stem 66 extends from button 18 down into the other end of the passage and is sealed by O-ring 68 being guided for sliding axial or telescopic movement against container outlet 62 to release and dispense foam between the sealing points as is well known. Spring 70 biases button 18 toward the upper position and a suitable stop 72 limits the depressed position of the actuator. In order for foam to pass around the actuator and out, stem 66 is spaced to define annulus 74 which, with grooves or extensions 76 on the bottom of stem 66, allows the foam material to pass into side passage 78 located substantially between the sealed points of stem 66 and container outlet 62 as shown in FIG. 4. The selectively dispensed foam passes through side passage 78, between the sealed points and then through heat exchanger 30 for heating and subsequent selective dispensing at 36.

It will be seen that member 44 is a single integrally molded resilient flexible plastic member fixed to the housing in top wall 24 by securing means through multiple ears 48 to lock against any relative movement whatever. It acts as the sole support of pressurized container 28 through projections 46 and with passage 60 it adapts to a large number of aerosol containers. With side passage 78 connecting to the heat exchanger, there is no flexing of parts and no motion except that of selective actuation of stem 66 and outlet 62. Thus, there is no wearing due to flexing of any connecting members resulting in a longer life and, with the telescopic function, there is wide adaptability to differing containers. Container 28 is rapidly and easily snapped in and out through the bottom of housing 10 and is well removed from the heat exchanger structure. The device is compact and aesthetically pleasing being very little higher than the container it is designed to hold. Thus, the moving parts of prior constructions have been replaced by a single valve member 44 that functions as a sole container support and valve assembly to accommodate many containers and selectively dispense controlled measured amounts of heated material to greatly simplify the construction at lower cost.

While there has been described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In an apparatus for electrically heating and dispensing flowable material from a pressurized container with an outlet and including a housing supporting the container, heat exchange means connected to receive material dispensed through a valve assembly, and means effecting temperature control of said material, the improvement in the housing and valve assembly comprising, a single universal valve assembly member supported on and passing through and permanently and fixedly secured to said housing to prevent relative motion therebetween, means on said member extending within the housing to lockingly engage and support a container through a rolled flange on said container, a tubular passage in said member having spaced seals therewith and fixedly receiving the container outlet telescopically through one end of the passage, an actuator stem sealingly and spacedly disposed in the other end of the passage for telescopic movement through the passage against the container outlet to release and dispense material, and a side passage in said member substantially between the spaced seals of said stem and outlet and connected to said exchanger, whereby said fixed member functions as substantially the sole container support and universal valve assembly for selectively dispensing controlled, heated, and measured material.

2. Apparatus as described in claim 1 wherein said valve assembly member is made of a flexible molded plastic and the means engaging said container are spaced integral projections depending within said housing with, said projections being biased outwardly from the axial centerline of said member.

3. Apparatus as described in claim 1 wherein said valve assembly member functions as the sole support for said container and said tubular passage is vertically disposed in said member with the actuator slidingly movable therein against the container outlet.

4. Apparatus as described in claim 2 wherein said projections have barbs thereon, whereby the barbs fixedly lock against the container rolled flange to prevent vertical movement of said container, 5. Apparatus as described in claim 4 having multiple ears on said valve assembly member, said ears having means securing them to said housing to fixedly lock the member to said housing.

6. Apparatus as described in claim 5 wherein said valve assembly member functions as the sole support for said container and said tubular passage is vertically disposed in said member with the actuator slidingly movable therein against the container outlet.

* * * * *